US007651374B2

(12) United States Patent
Feldman et al.

(10) Patent No.: US 7,651,374 B2
(45) Date of Patent: Jan. 26, 2010

(54) SYSTEM AND METHOD OF SURFACE MOUNT ELECTRICAL CONNECTION

(75) Inventors: Steven Feldman, Cedar Park, TX (US); Harald Westkamp, Neuss (DE); Alexander W. Barr, Austin, TX (US); Joseph N. Castiglione, Cedar Park, TX (US); Gerardus A.C.A. Nuiten, Neuss (DE); Guenter Ploehn, Neuss (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/136,674

(22) Filed: Jun. 10, 2008

(65) Prior Publication Data

US 2009/0305533 A1 Dec. 10, 2009

(51) Int. Cl.
*H01R 13/648* (2006.01)

(52) U.S. Cl. ..... 439/607.05; 439/607.13; 439/581

(58) Field of Classification Search ..... 439/608, 439/581, 579, 108, 607.05, 607.13
See application file for complete search history.

(56) References Cited

U.S. PATENT DOCUMENTS

| | | | |
|---|---|---|---|
| 5,114,355 | A | 5/1992 | Kimmel et al. |
| 5,184,965 | A | 2/1993 | Myschik et al. |
| 5,194,020 | A | 3/1993 | Voltz |
| 5,496,183 | A | 3/1996 | Soes et al. |
| 5,516,294 | A | 5/1996 | Andrews et al. |
| 5,904,594 | A | 5/1999 | Longueville et al. |
| 5,980,321 | A | 11/1999 | Cohen et al. |
| 5,993,259 | A | 11/1999 | Stokoe et al. |
| 6,146,202 | A | 11/2000 | Ramey et al. |
| 6,231,391 | B1 | 5/2001 | Ramey et al. |
| 6,238,245 | B1 | 5/2001 | Stokoe et al. |
| 6,299,483 | B1 | 10/2001 | Cohen et al. |
| 6,358,062 | B1 | 3/2002 | Feldman et al. |
| 6,368,120 | B1 | 4/2002 | Scherer et al. |
| 6,371,813 | B2 | 4/2002 | Ramey et al. |
| 6,379,188 | B1 | 4/2002 | Cohen et al. |
| 6,503,103 | B1 | 1/2003 | Cohen et al. |
| 6,506,076 | B2 | 1/2003 | Cohen et al. |
| 6,520,802 | B1 | 2/2003 | Mitra |
| 6,551,126 | B1 | 4/2003 | Feldman |
| 6,554,647 | B1 | 4/2003 | Cohen et al. |
| 6,607,402 | B2 | 8/2003 | Cohen et al. |
| 6,712,646 | B2 | 3/2004 | Shindo |

(Continued)

OTHER PUBLICATIONS

Amphenol TCS, VHDM Connector, http://www.amphenol-tcs.com/products/connectors/backplane/vhdm/index.html, printed on Feb. 25, 2008, 4 pages.

(Continued)

*Primary Examiner*—Gary F. Paumen
(74) *Attorney, Agent, or Firm*—Melanie G. Gover; Dean M. Harts

(57) ABSTRACT

An electrical connector system includes a carrier assembly and a header. The carrier assembly includes a plurality of shielded connectors and a coaxial cable terminated to each of the shielded connectors. The header includes opposed grounding plates each having ground tabs configured for attachment to a circuit board and a plurality of pins disposed between the opposed plates in a stripline configuration. The coaxial cables of the carrier assembly electrically communicate with the circuit board through a stripline configuration of pins in the header.

22 Claims, 13 Drawing Sheets

U.S. PATENT DOCUMENTS

| | | | | |
|---|---|---|---|---|
| 6,752,658 | B2 * | 6/2004 | Jones | 439/581 |
| 6,764,342 | B2 * | 7/2004 | Murayama et al. | 439/607.1 |
| 6,833,513 | B1 | 12/2004 | Ahmad | |
| 7,048,585 | B2 | 5/2006 | Milbrand, Jr. et al. | |
| 7,114,964 | B2 | 10/2006 | Winings et al. | |
| 7,384,306 | B2 * | 6/2008 | Malstrom et al. | 439/578 |
| 7,470,155 | B1 * | 12/2008 | Soubh et al. | 439/701 |
| 2001/0005654 | A1 | 6/2001 | Cohen et al. | |
| 2002/0111068 | A1 | 8/2002 | Cohen et al. | |
| 2003/0052755 | A1 | 3/2003 | Barnes et al. | |
| 2005/0070158 | A1 * | 3/2005 | Tateno | 439/581 |
| 2007/0141871 | A1 * | 6/2007 | Scherer et al. | 439/108 |
| 2007/0197095 | A1 * | 8/2007 | Feldman et al. | 439/608 |
| 2008/0020615 | A1 * | 1/2008 | Feldman et al. | 439/162 |

OTHER PUBLICATIONS

3M MetPak™ HSHM Backplane Connectors, Innovation HSHM Brochure, Copyright 3M 2002, 4 pages, 3M Electronic and Interconnect Solutions Division, Austin, TX.

* cited by examiner

SYSTEM AND METHOD OF SURFACE MOUNT ELECTRICAL CONNECTION

BACKGROUND

The connection of integrated circuits on circuit boards to cables or electronic devices is known in the art. Signals propagate through conductors of the connector as they pass to/from the circuit board. Electrical interconnections are not difficult to form when signal line densities are relatively low. In addition, signal integrity is much less of a concern when designing connectors for slow signal speed and/or slow data rate applications. However, equipment manufacturers and consumers continually desire ever higher signal line densities and faster data rates.

The available high speed interconnect solutions are typically complex, utilizing precisely fabricated component designs that are sensitive to even small manufacturing variations, and thus expensive and difficult to manufacture.

It is desirable to provide electrical connectors and connections between circuit boards, cables, or electronic devices having improved cost/performance ratio, high circuit switching speeds, increased signal line densities with controlled electrical characteristics, and improved/controlled signal integrity in a manner suited to meet the evolving demands of end users.

SUMMARY

One aspect provides an electrical connector system including a carrier assembly and a header. The carrier assembly includes a plurality of shielded connectors and a coaxial cable terminated to each of the shielded connectors. The header includes opposed ground plates each having solder tabs configured for attachment to a circuit board and a plurality of pins disposed between the opposed plates. When the carrier assembly is connected to the header, the coaxial cables of the carrier assembly electrically communicate with the circuit board through a stripline configuration in the header.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1:
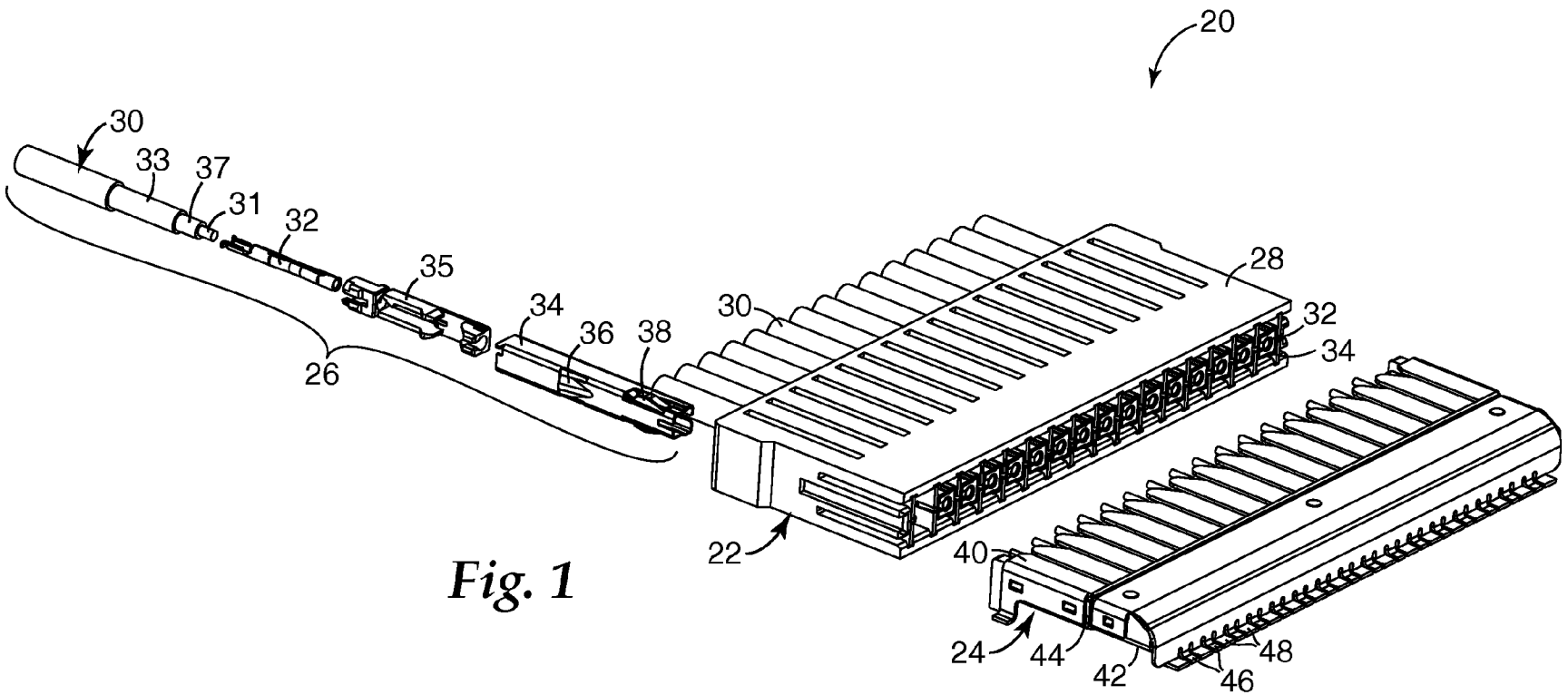
FIG. 1 is a perspective view of an electrical connector system including a carrier assembly attachable to a header according to one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

In this specification, the phrases "comprising a . . . " and "comprising an . . . " are each to mean a set including one or more.

In this specification, stripline means a conducting element that is spaced between opposing ground plates by air or by an insulator, such as a dielectric. A stripline configuration is one or more conducting elements (e.g., one or more pins) maintained by a dielectric a distance away from two opposing ground plates.

Embodiments provide a controlled impedance coaxial cable-to-stripline interconnect including a header that mates with a carrier assembly. Coaxial cable center conductors of the carrier assembly couple with signal pins of the stripline header. Coaxial cable shields of the carrier assembly couple with ground plates of the stripline header. In one embodiment, both ground plates mount to a circuit board. In another embodiment, one ground plate of the header is integrally formed as a portion of the printed circuit board and the cable shield couples to it via a ground contact of the connector shield body.

Embodiments of the header provide shielding against electromagnetic interference (EMI). Embodiments of the carrier provide improved signal integrity performance through the use of shielded controlled impedance connectors disposed within the carrier assembly.

One embodiment of the header provides a stripline configuration configured to improve band width over conventional right angle surface mount headers. One embodiment of the header eliminates the use of expensive gold plating applied to a ground pad of a printed circuit board. Headers as described herein are provided in a package having an overall height that is about fifty percent more compact than conventional headers. Other embodiments of the header/carrier assembly improve band width by about thirty percent above conventional interconnects with improved impedance control.

In one embodiment, the header provides right angle surface mount interconnect to a printed circuit board without the expense of mating to a right angle high speed hard metric connector. Embodiments of the header provide structured plates that couple together to provide a shell that eliminates the costly and precise drilled and plated through-hole support interfaces employed by conventional headers. Board trace routing area is increased through the elimination of plated through-holes. The reduction or elimination of plated through-holes reduces capacitance associated with the holes that typically causes impedance control variations in conventional interconnects.

FIG. 1 is a partially exploded perspective view of an electrical connector system 20 according to one embodiment. Electrical connector system 20 includes a carrier assembly 22 configured to mate with a controlled impedance stripline header 24. Carrier assembly 22 includes a plurality of shielded connectors 26 retained within a housing 28, where each of the shielded connectors 26 is terminated to a coaxial cable 30. In particular, each shielded connector 26 includes a contact 32 connected to a center conductor 31 of cable 30 and a shield body 34 connected to a shield 33 of cable 30, where shield body 34 is disposed around an insulator 35 that is disposed around contact 32. A dielectric 37 separates center conductor 31 from shield 33.

Cable 30 is a coaxial cable configured to terminate to contact 32 and shield body 34. Suitable shielded connectors are described in U.S. Pub. No. 20070197095, filed Jan. 25, 2007, e.g., in paragraphs [0041] to [0044] and FIGS. 6 to 9F, which description is incorporated herein.

Shield body 34 includes a latch 36 and ground beams 38. Shield body 34 generally provides an annular hull at a terminated end of cable 30. Shield body 34 includes any suitable shape such as a cylindrical hull, a hull having a square cross-sectional shape, or a hull having a rectangular cross-sectional shape. In one embodiment, latch 36 is formed on a surface that is separate from the surface on which the ground beams 38 are formed. Latch 36 is configured to secure shield body 34 within housing 28. One or more ground beams 38 projects from a surface of shield body 34. In one embodiment, shield body 34 includes two opposing ground beams 38, one projecting from an upper surface of shield body 34 and one projecting from a lower surface of shield body 34, for example, and as oriented in FIG. 1.

Header 24 includes a first plate 40 that couples with a second plate 42 to define a shell 44 that maintains a set of signal pins (See FIG. 4) in an aligned configuration for mating with contacts 32. First plate 40 is configured to couple with ground beams 38 on a first side of shield body 34 and includes a plurality of solder tabs 46 that are configured for attachment to a printed circuit board. Second plate 42 is configured to couple with ground beam 38 provided on an opposing second side of shield body 34 and includes a plurality of solder tabs 48 that are configured for attachment to a printed circuit board. In one embodiment, solder tabs 46 alternate in position with solder tabs 48 such that a trailing end of shell 44 is substantially enclosed and includes interdigitated solder tabs 46, 48.

Figure 2:
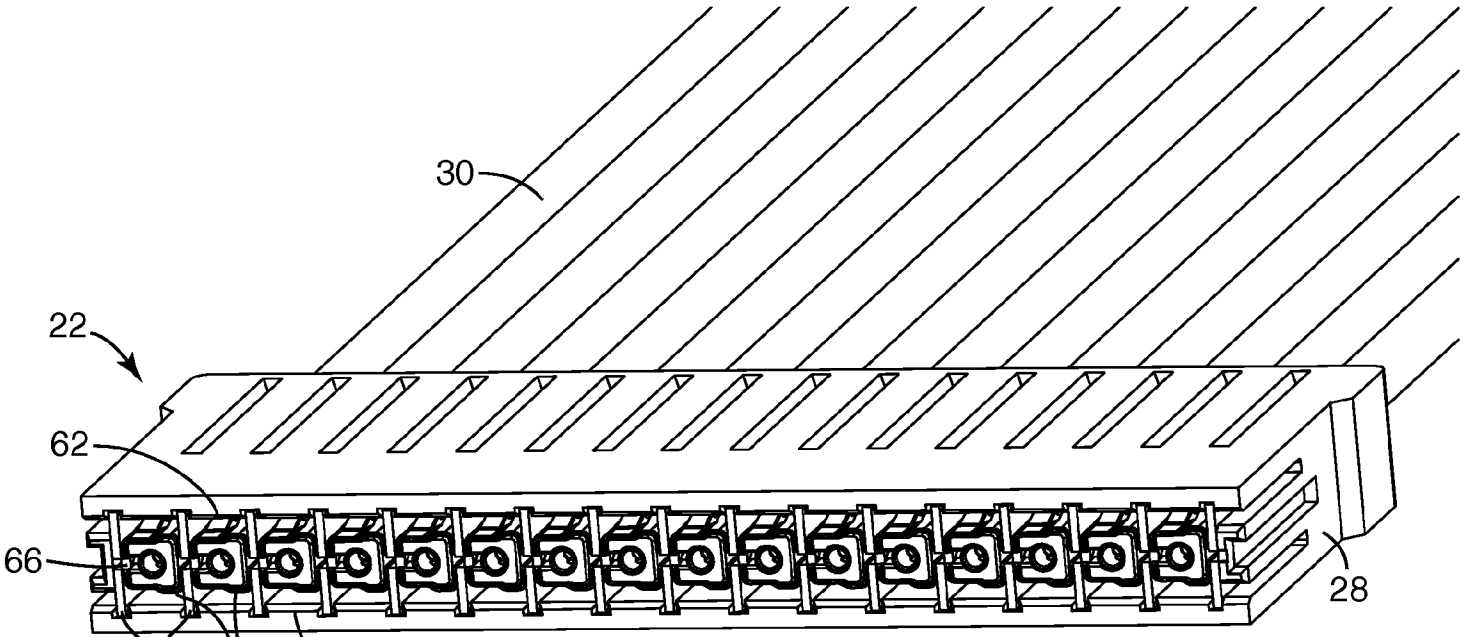
FIG. 2 is a front perspective view of the carrier assembly of FIG. 1.
Figure 3:
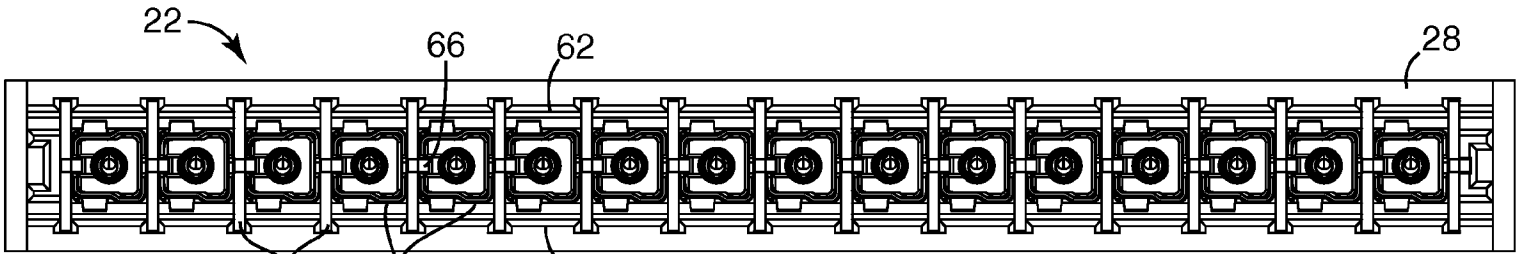
FIG. 3 is a front view of the carrier assembly shown in FIG. 2.

FIG. 2 is a perspective view and FIG. 3 is a front view of carrier assembly 22. In one embodiment, housing 28 is disposed around and supports a single row of shielded connectors 26. In one embodiment, sixteen shielded connectors 26 are disposed in a single row, although other numbers of shielded connectors 26 maintained by housing 28 are also acceptable. It is desirable to precisely orient or organize shielded connectors 26. In one embodiment, a separator plate 60 extends between opposed major surfaces 62, 64 of housing 28 to separate adjacent shielded connectors 26. In one embodiment, separator plate 60 includes a tab 66 that is configured to engage with shielded connector 26 to orient shielded connector 26 in a substantially fixed aligned position.

In one embodiment, housing 28 is fabricated from an electrically insulating material such as plastic and separator plates 66 are fabricated from thin rigid material such as metal. Housing 28 is fabricated, for example by molding, to provide an improved cost/performance ratio over machined and/or milled housings. Separator plates 66 are also fabricated to have an improved cost/performance ratio and are thus compatible with housing 28. Separator plates 66 are thin and compact while providing high rigidity and precise orientation of shielded connectors 26 within housing 28.

Figure 4:
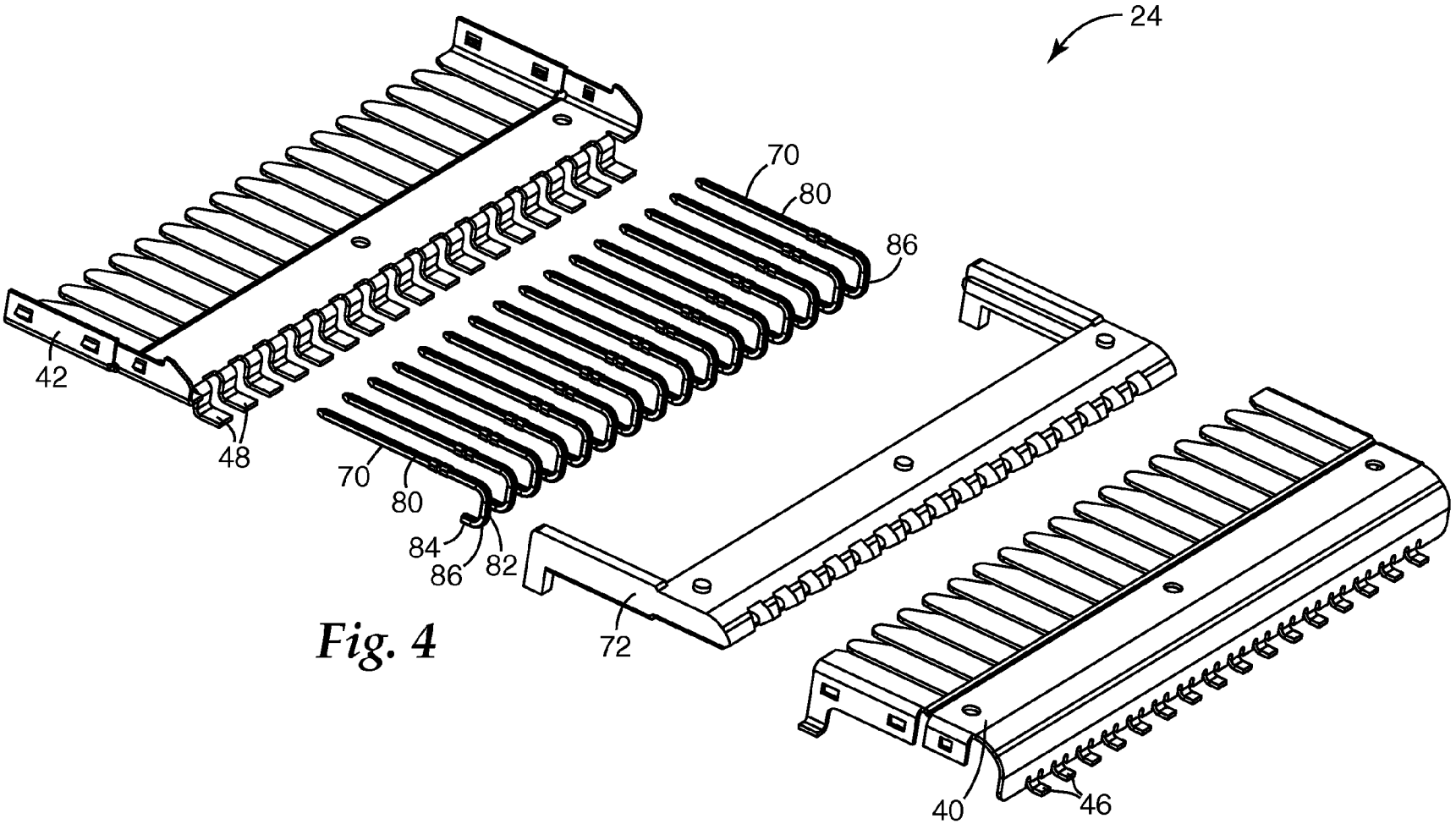
FIG. 4 is an exploded perspective view of the header shown in FIG. 1.

FIG. 4 is an exploded perspective view of header 24. In one embodiment, header 24 includes a plurality of signal pins 70 retained by a dielectric support 72 between first plate 40 and second plate 42. In one embodiment, pins 70 include signal pins where each pin has a contact portion 80 and a termination portion 86 including a tail 82 extending from contact portion 80 and a solder tail 84 extending from tail 82. Contact portion 80 is configured for electrical connection with contact 32 (FIG. 1). In one embodiment, signal pins 70 provide right angle signal pins and solder tail 84 is configured to be attached to a printed circuit board such that tail 82 is substantially perpendicular to the printed circuit board and contact portion 80 is substantially parallel to the printed circuit board. Dielectric support 72 is configured to retain signal pin 70 in a precisely aligned configuration for coupling with the precisely aligned shielded connectors 26 (FIG. 1). When assembled, dielectric support 72 is configured such that crosstalk to each of the pins 70 in stripline header 24 is minimized by a dielectric distance between adjacent pins 70 being about twice a dielectric thickness extending between one of the pins 70 and one of the opposed first and second plates 40, 42.

Figures 5, 6:
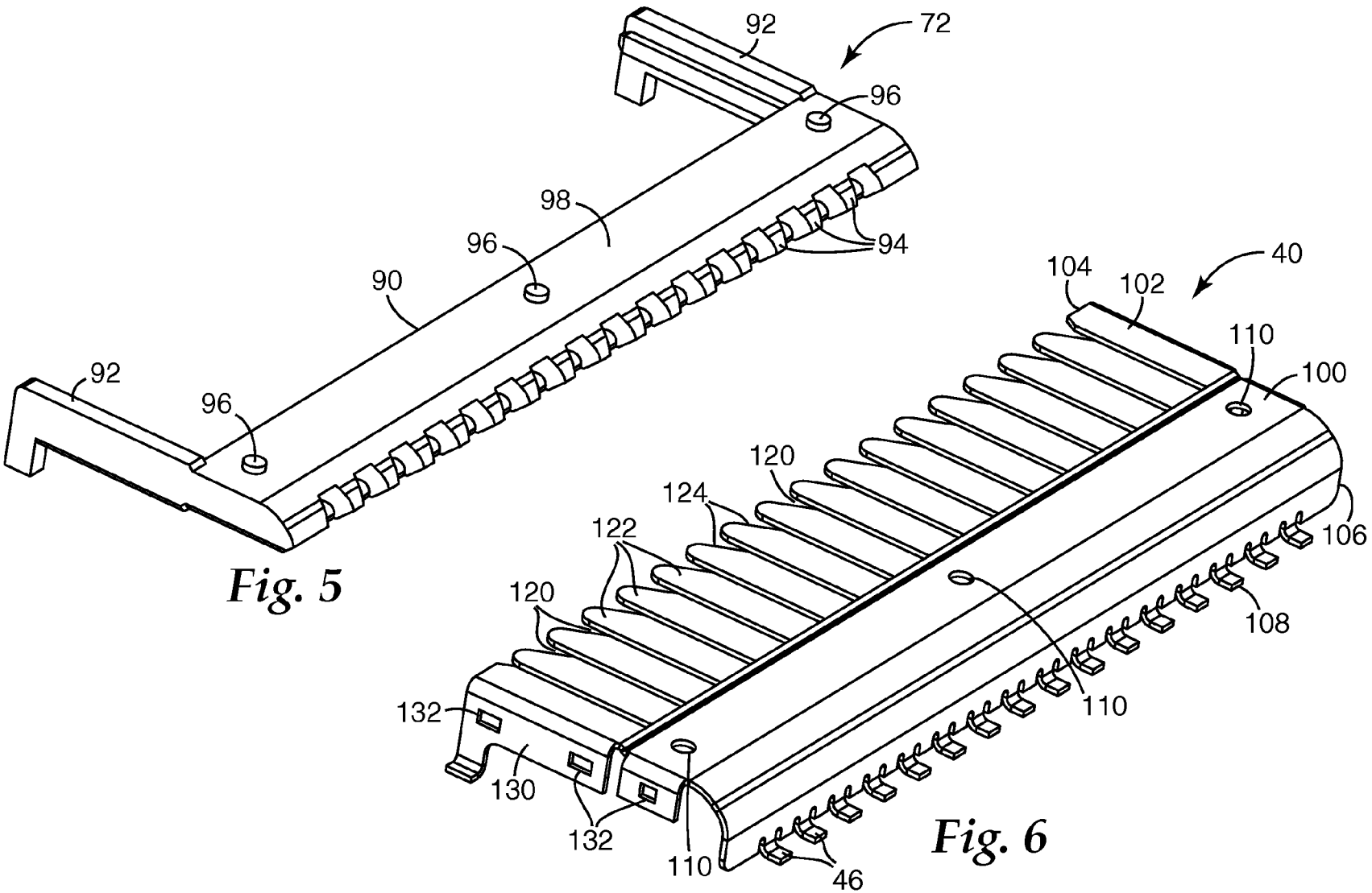
FIG. 5 is a perspective view of a dielectric support of the header shown in FIG. 4 according to one embodiment.
FIG. 6 is a perspective view of a top plate of the header shown in FIG. 4 according to one embodiment.

FIG. 5 is a perspective view of dielectric support 72. In one embodiment, dielectric support 72 includes a bridge 90 extending between arms 92. Bridge 90 defines a plurality of slots 94, where each slot 94 is configured to align and retain one pin 70 (FIG. 4). In one embodiment, bridge 90 includes alignment posts 96 on an upper surface 98 and opposing alignment posts (not shown) on a lower surface. Alignment posts 96 are configured to couple with first plate 40 (FIG. 4) to fix dielectric support 72 in position relative to shell 44. In this manner, dielectric support 70 has minimal movement relative to shell 44, and pins 70 retained by dielectric support 72 likewise have minimal movement relative to first plate 40 and second plate 42.

FIG. 6 is a perspective view of first plate 40. First plate 40 includes a base 100, a leading end portion 102 extending from base 100 and terminating in a leading end 104, and a trailing end portion 106 extending from base 100 and terminating in trailing end 108. Solder tails 46 extend from trailing end portion 106 to trailing end 108. In one embodiment, base 100 includes alignment windows 110 configured to receive alignment posts 96 (FIG. 5). Alignment posts 96 and alignment windows 110 cooperate to fix or retain in place dielectric support 72.

In one embodiment, leading end portion 102 includes a plurality of slots 120 that combine to define a plurality of fingers 122 extending from base 100. In one embodiment, slots 120 extend from leading end 104 to base 100, and a portion 124 of leading end 104 of each finger 122 is tapered. In other words, taper 124 extends from a leading end 104 of each finger 122 a portion of the way into slot 120.

First plate 40 is configured to snap together with second plate 42 to enclose dielectric support 72 and pins 70 maintained by dielectric 72 to form stripline configured header 24. In one embodiment, each opposing side 130 of first plate 140 includes openings 132 configured to enable first plate 40 to snap together with second plate 42.

Figure 7:
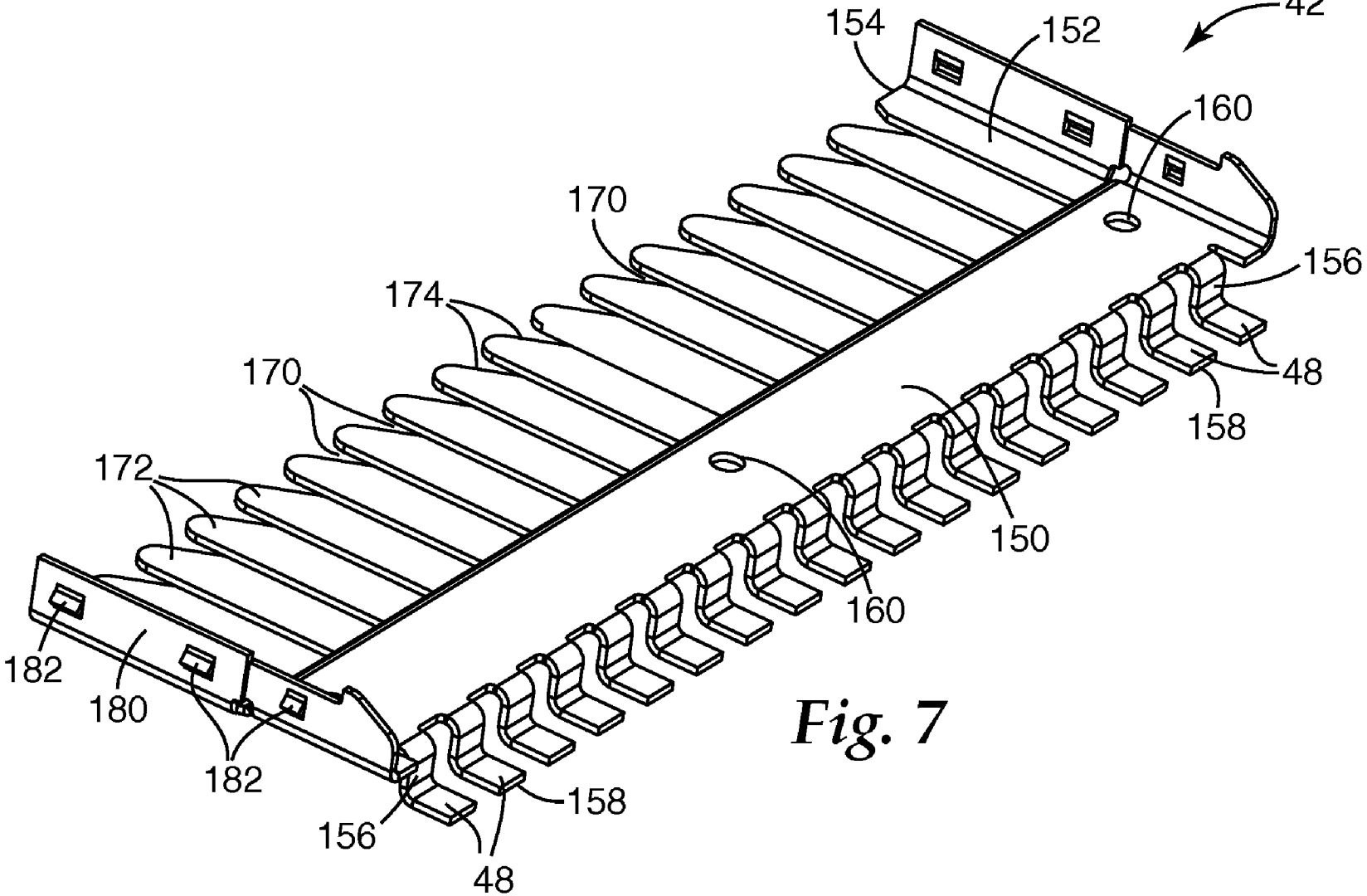
FIG. 7 is a perspective view of a bottom plate of the header shown in FIG. 4 according to one embodiment.

FIG. 7 is a perspective view of second plate 42. Second plate 42 includes a base 150, a leading end portion 152 extending from base 150 and terminating in a leading end 154, and a trailing end portion 156 terminating in a trailing end 158. In one embodiment, base 150 of second plate 42 defines alignment windows 160 configured to receive alignment posts 96 (FIG. 5). Alignment windows 160 and alignment posts 96 are configured to cooperate to retain dielectric support 72 in a substantially fixed orientation inside shell 44.

In one embodiment, leading end portion 152 defines a plurality of slots 170 and a plurality of fingers 172, where each finger 172 is provided between adjacent slots 170. In one embodiment, a taper 174 is provided for each finger 172, where taper 174 extends from leading end 154 a portion of the way into slot 170.

Opposing sides of second plate 42 define projections 182 extending outward from sides 180. Projections 182 are configured to engage with openings 132 (FIG. 6) such that first plate 40 snap fits together with second plate 42 and projections 182 are received by openings 132.

Trailing end portions 156 are substantially orthogonal to base 150, and solder tails 48 are substantially orthogonal to trailing end portion 156. In this manner, trailing end portion 156 descends at about a right angle relative to base 150 and solder tail 48 extends at about a right angle relative to trailing end portion 156.

Figure 8:
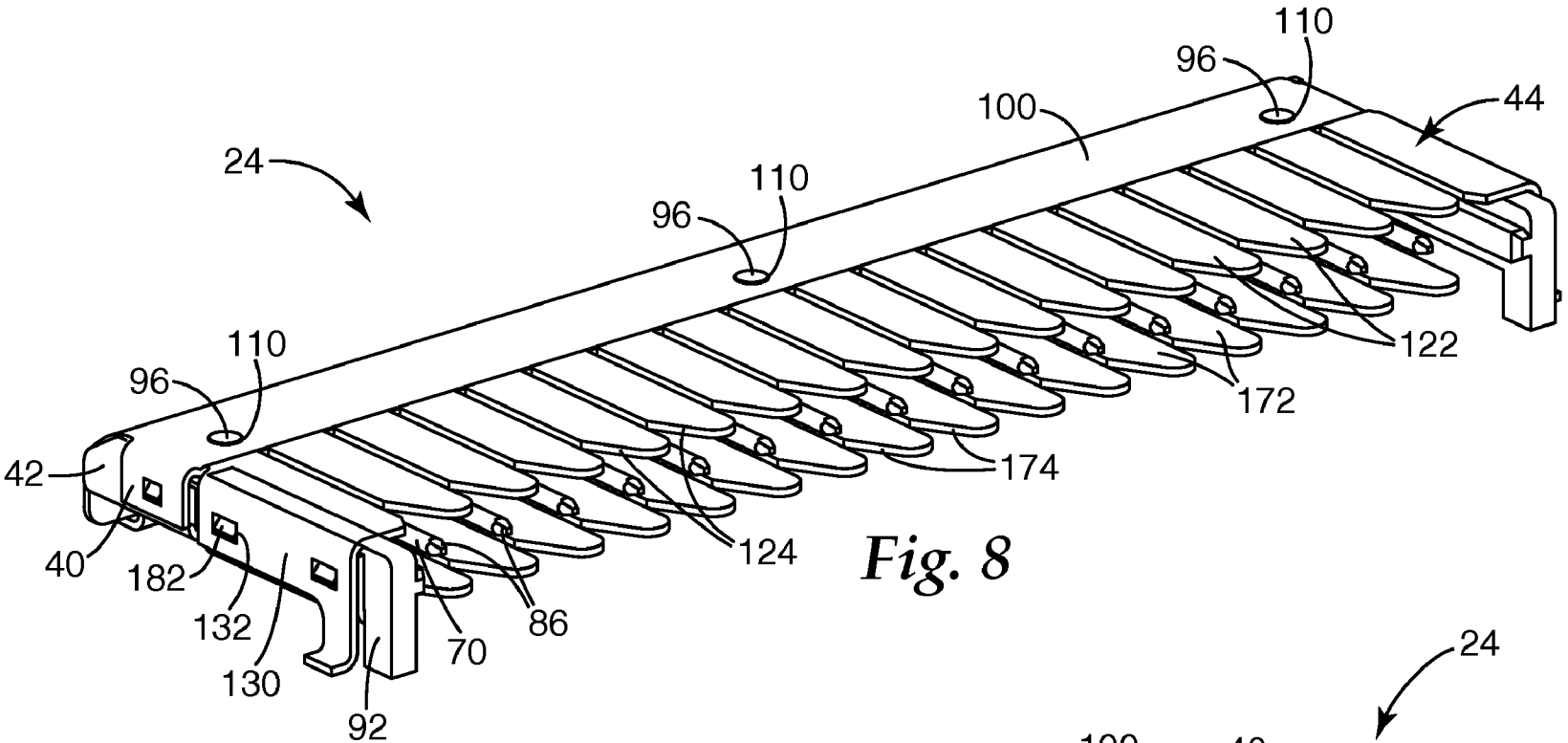
FIG. 8 is a perspective view of the header shown in FIG. 4 as assembled.
Figure 9:
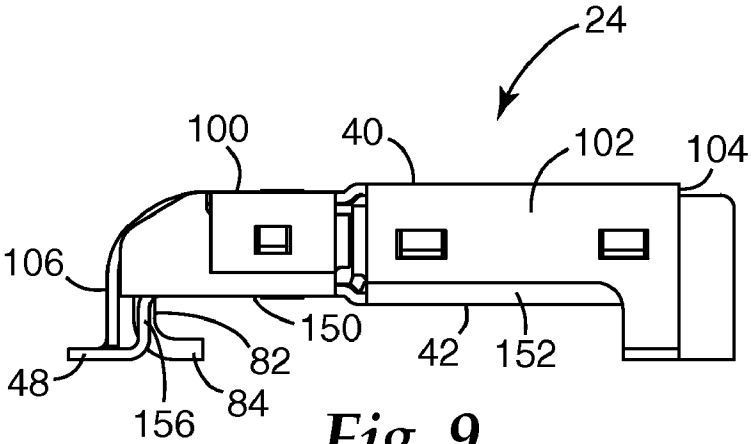
FIG. 9 is a side view of the header shown in FIG. 8.

FIG. 8 is a perspective view and FIG. 9 is a side view of header 24. First plate 40 is coupled to second plate 42 to retain dielectric support 72 such that pins 70 are aligned relative to fingers 122, 172. In particular, alignment posts 96 are secured within alignment windows 110, a contact portion 80 of pin 70 is aligned between and parallel with fingers 122 of first plate 40 and fingers 172 of second plate 42. With additional reference to FIG. 4, pin 70 is retained within dielectric support 72 such that a contact portion 80 of pin 70 projects from a leading end of shell 44. In this manner, header 24 provides a right angle surface mount header and pins 70 are provided in a stripline configuration between grounding plates 40, 42. Specifically, contact portion 80 of pins 70 and fingers 122, 172 provide header 24 with a stripline configuration.

Tail portion 82 of pin 70 is substantially orthogonal to contact portion 80 and orthogonal to fingers 122, 172. Tail portion 82 of each pin 70 is shielded on two sides by a trailing end portion 156 of second plate 42, and shielded on one side by a trailing end portion 106 of first plate 40. In this manner, tail portion 82 of pin 70 is shielded on at least three sides by laterally descending trailing end portions 156 of second plate 42 and parallel and offset trailing end portion 106 of first plate 40.

It is to be understood that the orientation of tabs 46, 48 (tab 46 is behind tab 48 in this view) relative to solder tail 84 could be reversed. That is to say, tabs 46, 48 could be oriented to the right in FIG. 9 and solder tail 84 could be oriented to the left. In one embodiment, the relative orientation of tabs 46, 48 and solder tail 84 is reversed from the order shown in FIG. 9 to provide header 24 with substantially similar electrical performance but improved ease of visually confirming the solder connection of solder tail 84.

Fingers 122, 172 are configured to align shield bodies 34 of shielded connectors 26 (FIG. 1). Pins 70 are positioned between plates 40, 42 without an intervening wall or other support that could potentially provide an impedance discontinuity when carrier assembly 22 (FIG. 1) is connected to header 24. In this manner, header 24 is configured to provide interconnection for high speed signals and provide a stripline configuration having controlled impedance.

With additional reference to FIG. 1 and FIGS. 6-7, when carrier assembly 22 is introduced to header 24, a respective slot 120 between fingers 122 engages with a respective one of the separator plates 60 to provide initial lateral alignment of header 24 relative to carrier assembly 22. Further engagement of carrier assembly 22 into header 24 engages fingers 122, 172 with shield bodies 34, and fingers 122, 172 lift shield bodies 34 to precisely align contact 32 inside each shielded connector 26 with contact portion 80 of pin 70. When connected, carrier assembly 22 is inserted over header 24, which engages each pin 70 with each aligned contact 32 inside carrier assembly 22. Ground beams 38 contact fingers 122, 172 to form a ground matrix around signals traveling through pins 70.

In one embodiment, tapered portions 124, 174 of fingers 122, 172, respectively, are configured to provide and/or ensure lateral alignment of shield bodies 34 relative to each signal pin 70 inside header 24. In addition, the tapered portions 124, 174 of fingers 122, 172 provide a lead-in configured to align with the separator plates 60 of carrier assembly 22 to provide vertical alignment (i.e., in the non-lateral direction) of header 24 as it engages with carrier assembly 22.

Figure 10A:
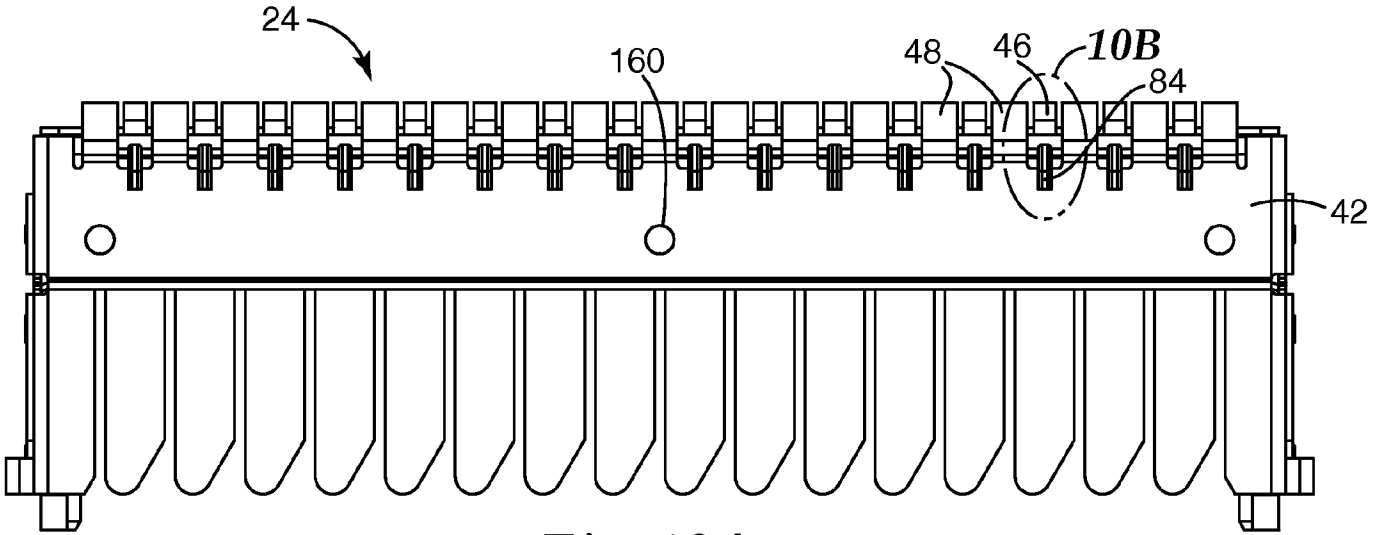
FIG. 10A is a bottom view of the header shown in FIG. 8.

FIG. 10A is a bottom view of header 24. Solder tail 84 of each pin 70 (FIG. 4) is available for attachment to a printed circuit board. With additional reference to FIGS. 6 and 7, trailing end 106 of solder tab 46 shield tail 82 of pins 70, and adjacent in lateral portions of solder tabs 48 shield the lateral side of pins 70.

Figure 10B:
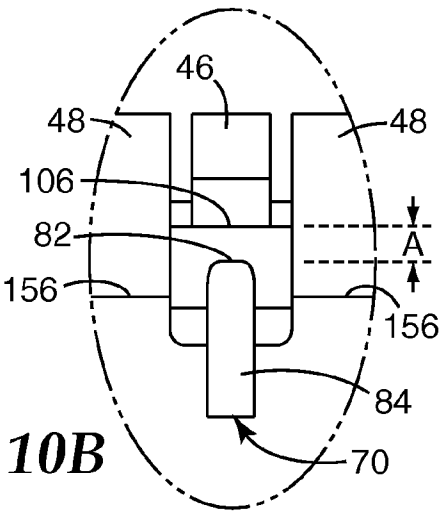
FIG. 10B is an enlarged view of one shielded signal pin of the header shown in FIG. 10A.

FIG. 10B is an expanded view of pin 70 shielded on three sides from electromagnetic interference. A trailing end portion 106 of solder tab 46 formed on first plate 40 is offset away from tail 82 of pin 70 by the distance A. In one embodiment, the distance A is configured to provide signal pin 70 with controlled impedance for the stripline configuration of header 24. Trailing end portions 156 of adjacent solder tabs 48 shield the lateral sides of pin 70 from electromagnetic interference. In one embodiment, the trailing end portions 106, 156 of respective solder tabs 46, 48 combine to surround about seventy-five percent of a circumference of pin 70 in a manner that substantially reduces cross-talk between signals within pins 70. In other words, each pin 70 has a substantially coaxial structure having about 75% of a circumference of the structure surrounded by a ground formed in part by the trailing end portions 106, 156 of respective solder tabs 46, 48.

Figure 11:
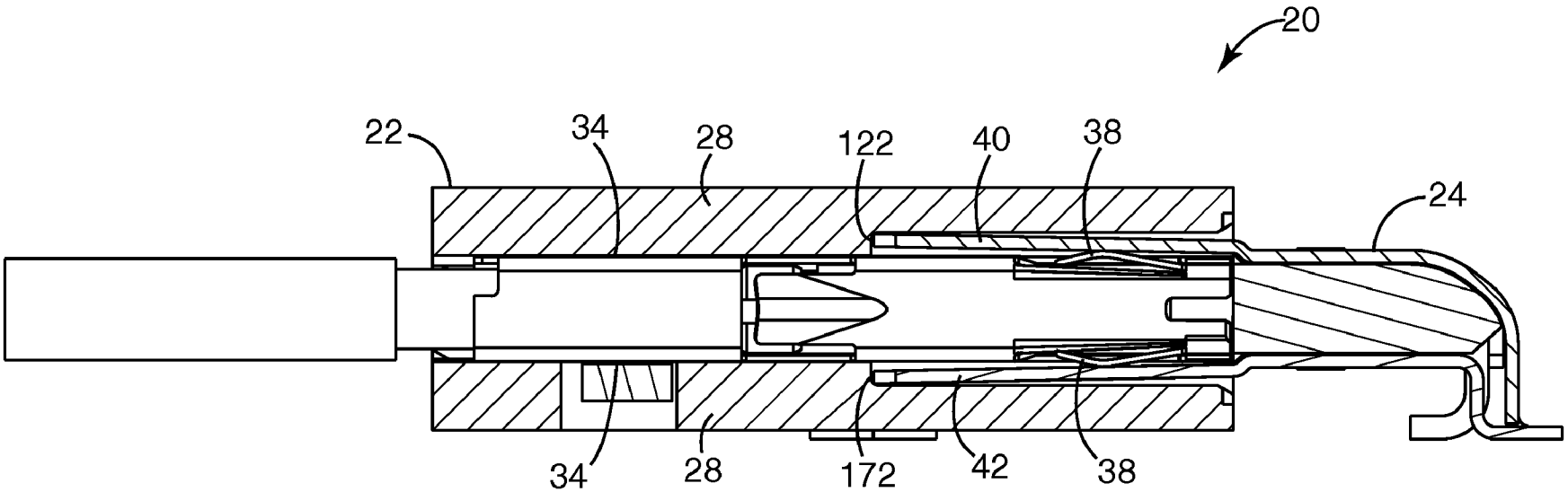
FIG. 11 is a cross-sectional view of the carrier assembly shown in FIG. 1 attached to the header shown in FIG. 1.

FIG. 11 is a cross-sectional view of system 20 showing carrier assembly 22 attached to header 24. Leading portions of the opposed ground plates 40, 42 define a plurality of fingers 122, 172, respectively, where each finger 122, 172 is configured to be captured between the housing 28 of the carrier assembly 22 and one of the shield bodies 34. In one embodiment, ground beams 38 flex away from shield body 34 and bear against fingers 122, 172 of header 24, which presses fingers 122, 172 outward or away from shield body 34 and against housing 28. The walls of housing 28 prevent the fingers 122, 172 from deflecting, and thus ensure that ground beams 38 make contact with ground plates 40, 42.

Figure 12:
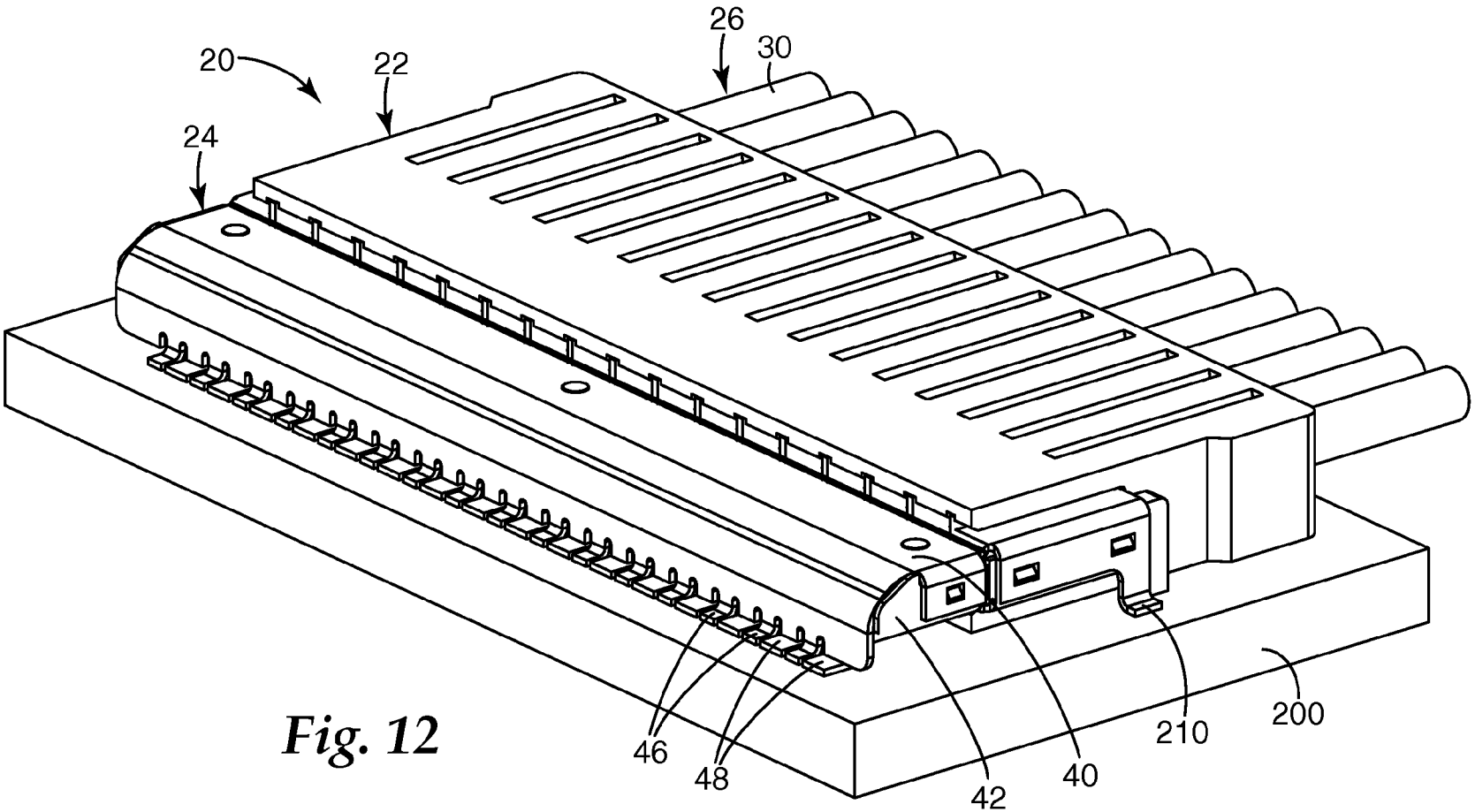
FIG. 12 is a perspective view of a controlled impedance stripline header coupled to a circuit board and a carrier assembly coupled to the header according to one embodiment.

FIG. 12 is a perspective view of electrical connector system 20 coupled to a printed circuit board 200. Header 24 is soldered to printed circuit board 200 at least at solder tabs 46, 48. In one embodiment, header 24 is soldered to printed circuit board 200 at solder tabs 46, 48 and at solder wings 210. Solder wings 210 provide an additional fastening feature that secures header 24 to board 200 in a manner that minimizes/reduces the risk of bending assembly 22 or damaging assembly 22/header 24 when forming the interconnection. In one embodiment, cables 30 are coaxial cables and connector 26 is secured within carrier assembly 22 and coupled to the stripline configuration of signal pins within header 24. In this manner, electrical connector system 20 enables electrical connection of coaxial cables 30 with printed circuit board 200 through a stripline configuration within header 24.

With additional reference to FIG. 8, when carrier assembly 22 is mated to header 24, separator plates 60 of the carrier assembly 22 insert into slots 120 of opposed plates 40, 42 to laterally align contacts 32 in shielded connectors 26 with pins 70 in header 24. Following further insertion, fingers 122 of opposed plates 40, 42 capture the shielded connectors 26 to vertically align contacts 32 in shielded connectors 26 with pins 70 in header 24. Each tapered portion 124 on each finger 122 is configured to assist in locating finger 122 (or adjusting placement of finger 122) relative to separator plate 60.

Conventional interconnect assemblies employ an alignment wall or sockets formed in a support structure to ensure interconnection of cables to the circuit board. In contrast, connectors 26 communicate directly with header 24 attached to printed circuit board 200. Header 24 aligns connectors 26 during insertion without employing intervening walls or other such impedance discontinuities. This direct form of interconnection configures electrical connector system 20 for high speed signal transmission in a controlled impedance manner.

Figure 13:
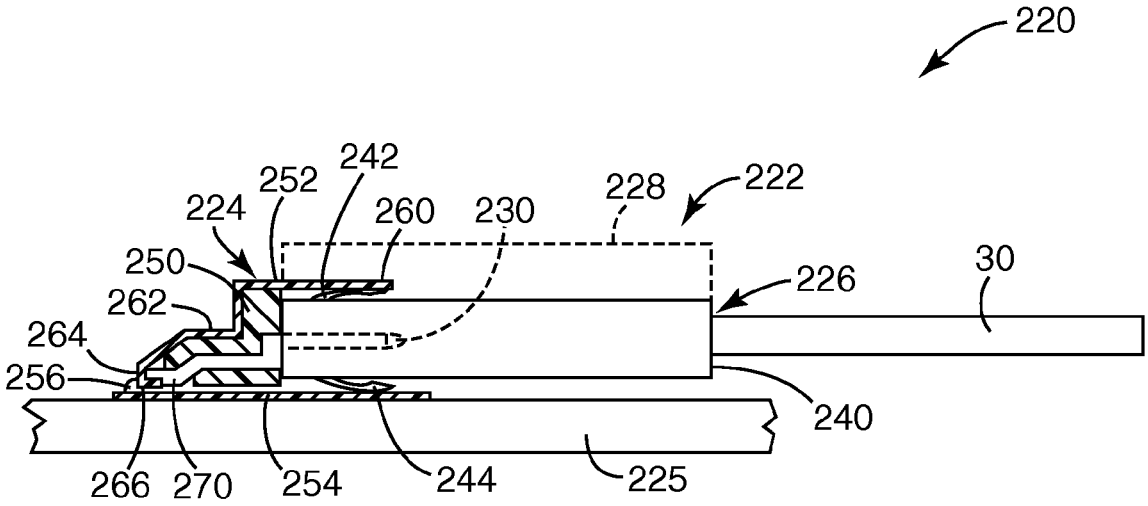
FIG. 13 is a cross-sectional view of a header having a bottom plate fabricated as a feature on a printed circuit board and configured to receive a carrier assembly according to another embodiment.
Figure 14:
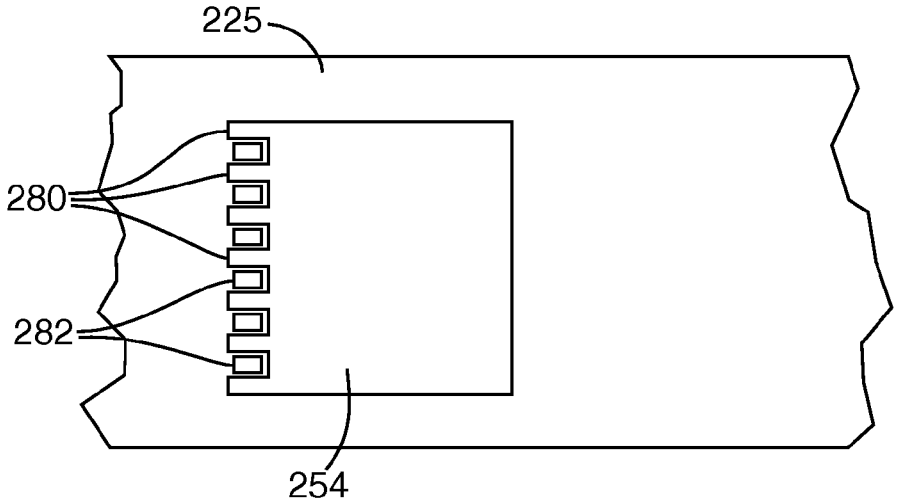
FIG. 14 is a top view of the printed circuit board shown in FIG. 13.

FIG. 13 is a cross-sectional view of an electrical connector system 220 including a carrier assembly 222 connected to a printed circuit board 225, and FIG. 14 is a top view of fabricated features of printed circuit board 225. Carrier assembly 222 includes a row of shielded connectors 226 coupled to a header 224. Each shielded connector 226 is grounded between a ground plate 252 provided by header 224 and a ground plate 254 (or ground pad 254) provided as a fabricated feature of printed circuit board 225. In this manner, header 224 combines with printed circuit board 225 to provide a stripline configuration for cables/connectors that electrically communicate with printed circuit board 225. Signal pins 230 of header 224 communicate with printed circuit board 225 and are configured to receive connectors 226 of carrier assembly 222.

In one embodiment, carrier assembly 222 supports a single row of shielded connectors 226 within a housing 228, although other configurations are also acceptable. Housing 228 is not shown in cross-section for ease of illustration. Shielded connectors 226 are substantially similar to shielded connectors 26 described above in FIG. 1 and cable 30 is a coaxial cable similar to the cable 30 described above.

In one embodiment, shielded connector 226 includes a shield body 240 having a first ground wiper 242 that contacts ground plate 252 of header 224 and a second ground wiper 244 that contacts ground plate 254 of printed circuit board 225. Ground wipers 242, 244 are resilient, flexible grounding beams. In one embodiment, ground wiper 244 is different than ground wiper 242 and configured to have a wider range of resilient flexation away from shield body 240, as described below.

Header 224 includes an electrical insulator 250 supporting a row of pins 230 that are separated from ground plate 252 and ground pad 254 to provide a stripline configuration for header 224. Lower plate 254 is fabricated to be integral with, or provided as an upper surface, of printed circuit board 225. Plate 252 is soldered to printed circuit board 225 by a fillet of solder 256, which potentially elevates plate 252 and pin 230 off of board 225. Ground wiper 244 is configured to have a sufficient range of resilient flexation to ensure that ground wiper 244 will extend fully away from shield body 240 and make connection with plate 254 on printed circuit board 225.

Plate 252 is configured to follow a shape of pin 230. Plate 252 includes a leading portion 260, a trailing portion 262 extending from leading portion 260, a trailing end 264 extending from trailing portion 262, and a solder tab 266. Pin 230 is shaped such that a trailing end 270 of pin 230 within insulator 250 is nearer to plate 254 than a leading end of pin 230 that couples with connector 226. With this configuration, a desired and electrically suitable dielectric spacing is achieved between pin 230 and the printed circuit board 225 and between pin 230 and plate 252. In one embodiment, insulator 250 is structured to maintain this above-described desired spacing for pin 230 such that a nearly symmetric or balanced capacitive coupling is provided and header 224 has a stripline configuration. In particular, the stripline configuration is defined by the first ground wiper 242 contacting ground plate 252 of header 224 and the second ground wiper 244 contacting ground plate 254 of printed circuit board 225.

Printed circuit board 225 includes ground pad 254 that defines a series of spaced apart grounding sections 280 and a series of alternating signal pads 282. Each signal pad 282 is disposed between an adjacent pair of grounding sections 280. The spacing between signal pads 282 and the spacing between grounding sections 280 is each selected to provide controlled impedance for header 224 when attached to printed circuit board 225.

When header 224 is attached to printed circuit board 225, each trailing end 264 of plate 252 is soldered or otherwise connected to a respective one of the grounding sections 280, and each trailing end 270 of each pin 230 is soldered or otherwise connected to a respective one of signal pads 282. First ground wiper 242 contacts plate 252 of header 224 and second ground wiper 244 extends from shield body 240 and contacts ground pad 254 of printed circuit board 225. Trailing end 264 provides a series of spaced apart segments 264 that interdigitate to shield signal pins 230 from outside interference. In a manner similar to that as described above in FIGS. 9-10, solder tabs 266 extend alongside trailing ends 270 of pins 230 and are connected to printed circuit board 225 to shield lateral sides of signal pins 230 and minimize cross-talk of signals within system 220.

Figure 15:
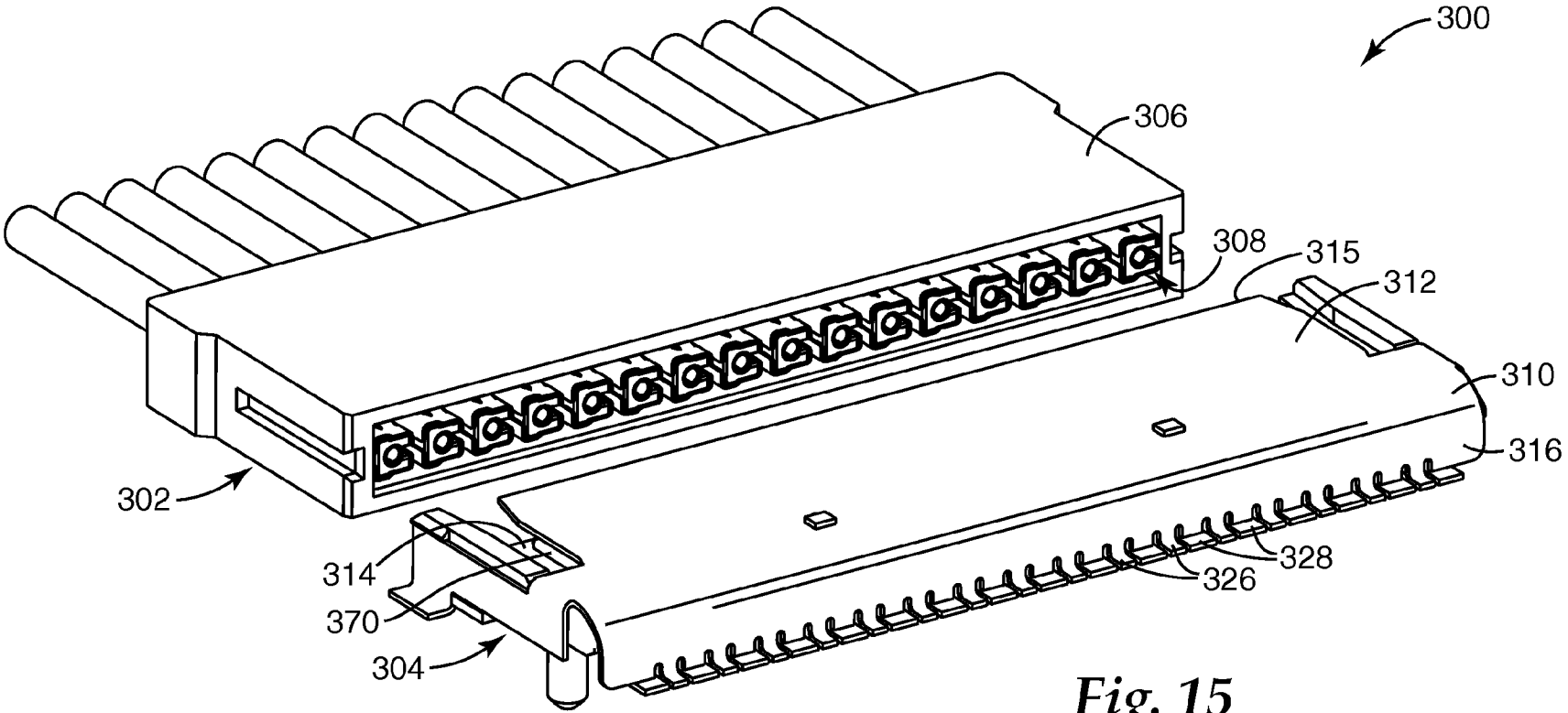
FIG. 15 is a perspective view of an electrical connector system including a carrier assembly positioned for attachment to a header according to another embodiment.

FIG. 15 is a perspective view of an electrical connector system 300 according to another embodiment. System 300 includes a carrier assembly 302 configured to mate with a controlled impedance stripline header 304. Carrier assembly 302 includes a housing 306 that aligns a row of shielded connectors 308 for electrical connection with header 304.

Header 304 includes a shell 310 having a first ground plate 312 spaced from a second ground plate 314. Header 304 is similar to header 24 (FIG. 1) in that first ground plate 312 and second ground plate 314 terminate along a leading end 316 of shell 310 to define alternating or interdigitating solder tabs 326, 328, respectively. In one embodiment, a leading portion 315 of the first and second plates 312, 314 provides a continuous plate extending substantially between first and second sides of surface mountable header 304.

A dielectric or insulating insert (not shown) is retained within shell 310 and a row of pins (not shown) is disposed between ground plates 312, 314. The dielectric or insulating insert is configured such that crosstalk to each of the pins 370 (best shown in FIG. 18) in stripline header 304 is minimized by a dielectric distance between adjacent pins 370 being about twice a dielectric thickness extending between one of the pins 370 and one of the opposed first and second plates 312, 314. The pins 370 within header 304 electrically connect with connectors 308 when carrier assembly 302 is inserted into header 304.

Figure 16:
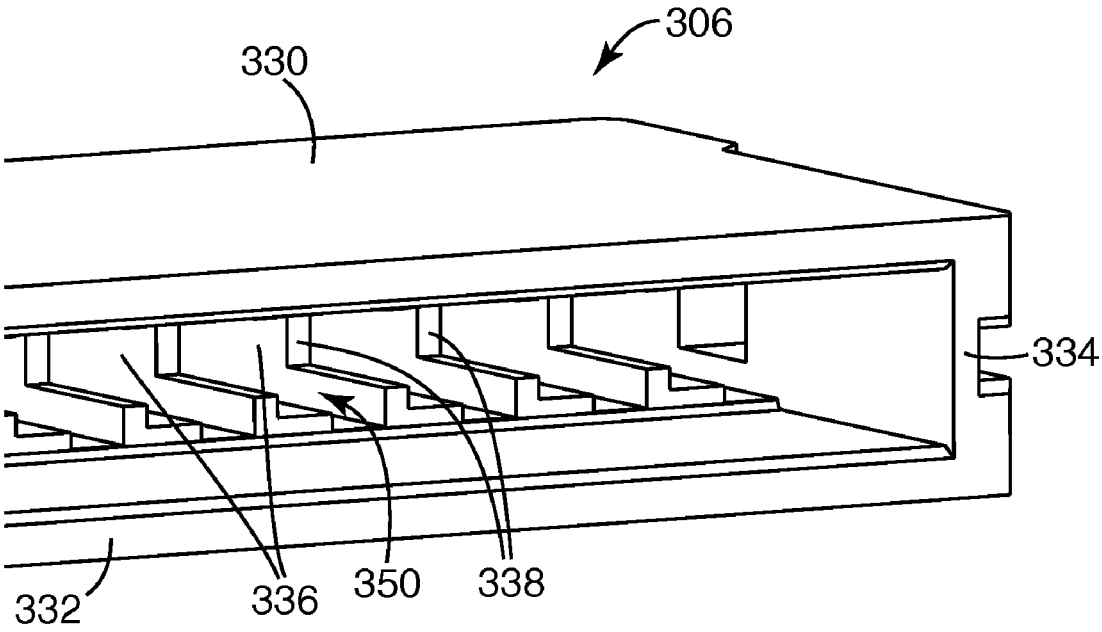
FIG. 16 is a front perspective view of a housing of the carrier assembly shown in FIG. 15.

FIG. 16 is a perspective view of housing 306. Housing 306 is provided without separator plates, but instead employs walls 336 that are inexpensive to mold in comparison to stamped or otherwise fabricated metal plates. Walls 336 are configured to align the connectors 308 inside housing 306 in a suitably precise manner at a relatively lower cost that housings that have separator plates. Housing 306 includes a first wall 330 opposite a second wall 332 and opposing end walls 334 (one shown). In one embodiment, a plurality of spaced apart upstanding walls 336 is integrally formed between walls 330, 332 to segregate housing 306 into discrete housing ports 350. Each spaced apart upstanding wall 336 includes a bearing surface 338 that is configured to engage with a latch 356 (FIG. 18) of shielded connector 308 to retain the shielded connectors 308 within ports 350. Each housing port 350 is sized to receive a shielded connector 308 (FIG. 15) and maintain shielded connector 308 in a desired and precise alignment suited for mating with header 304 (FIG. 15).

Figure 17:
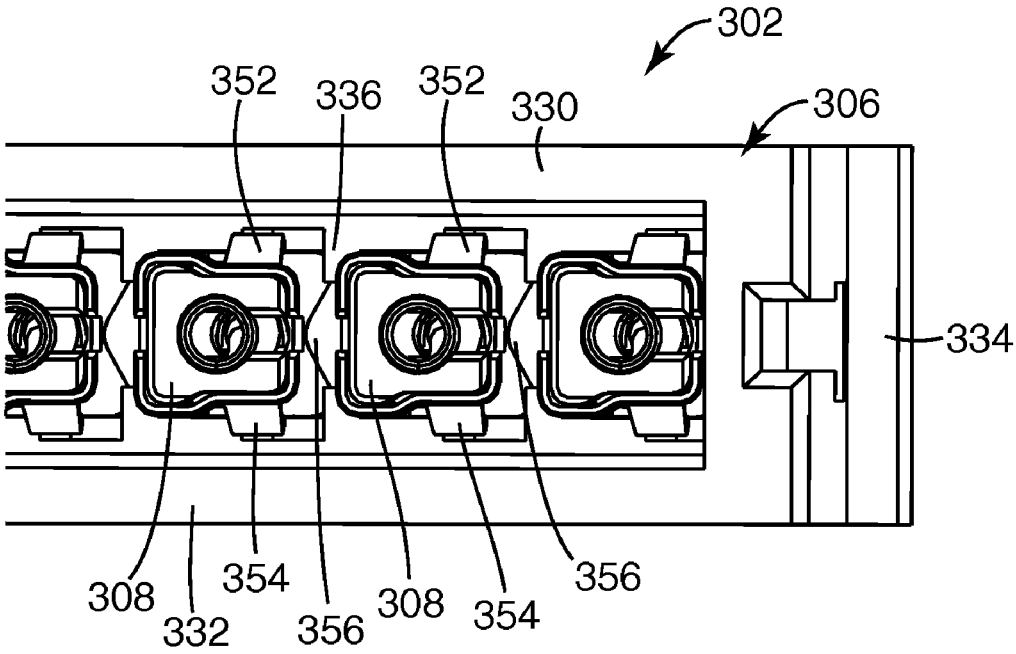
FIG. 17 is a front view of the carrier assembly shown in FIG. 15.

FIG. 17 is a front view of carrier assembly 302. One shielded connector 308 is inserted and retained within each housing port 350. In one embodiment, each shielded connector 308 includes a first ground beam 352, a second ground beam 354, and a latch 356. When assembled, first ground beam 352 is adjacent to first wall 330, second ground beam 354 is adjacent to second wall 332, and latch 356 engages with bearing surfaces 338 (FIG. 16) of upstanding walls 336 to secure connector 308 within port 350. The opposing lateral walls 330, 332 combine with upstanding walls 336 to form housing ports 350 that maintain shielded connectors 308 in a precise and desired alignment for mating with signal pins within header 304 (FIG. 15).

Figure 18:
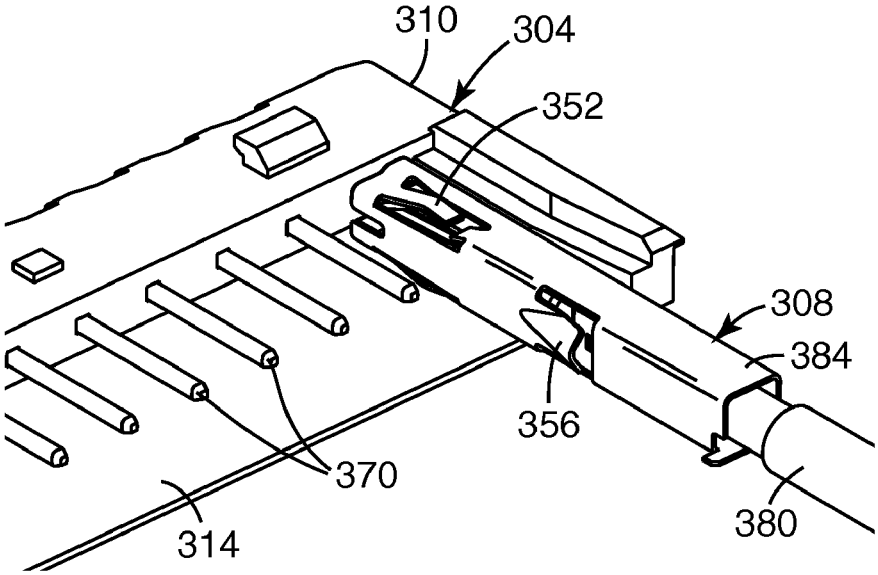
FIG. 18 is a perspective view of a portion of the header shown in FIG. 15 having a shielded connector inserted over a pin of the connector according to one embodiment.

FIG. 18 is a perspective view of header 304 having first plate 312 removed to better illustrate shielded connector 308 coupled with a signal pin 370 of header 304. When carrier assembly 302 (FIG. 17) is mated to header 304, shielded connector 308 engages with signal pin 370. Lower ground beam 354 (FIG. 17) contacts second ground plate 314 and upper ground beam 352 is positioned to contact or ground against first ground plate 312 (FIG. 15). Latch 356 is ordinarily engaged within housing 306 (FIG. 17) to secure shielded connector 308 within carrier assembly 302. Shielded connector 308 is similar to shielded connector 26 (FIG. 1) and includes a coaxial cable 380 terminated to a contact (not shown) within a shield body 384. In one embodiment, ground beams 352, 354 project from opposed exterior surfaces of shield body 384 and latch 356 projects from a surface that is different from either of the opposed exterior surfaces of shield body 384.

Figure 19:
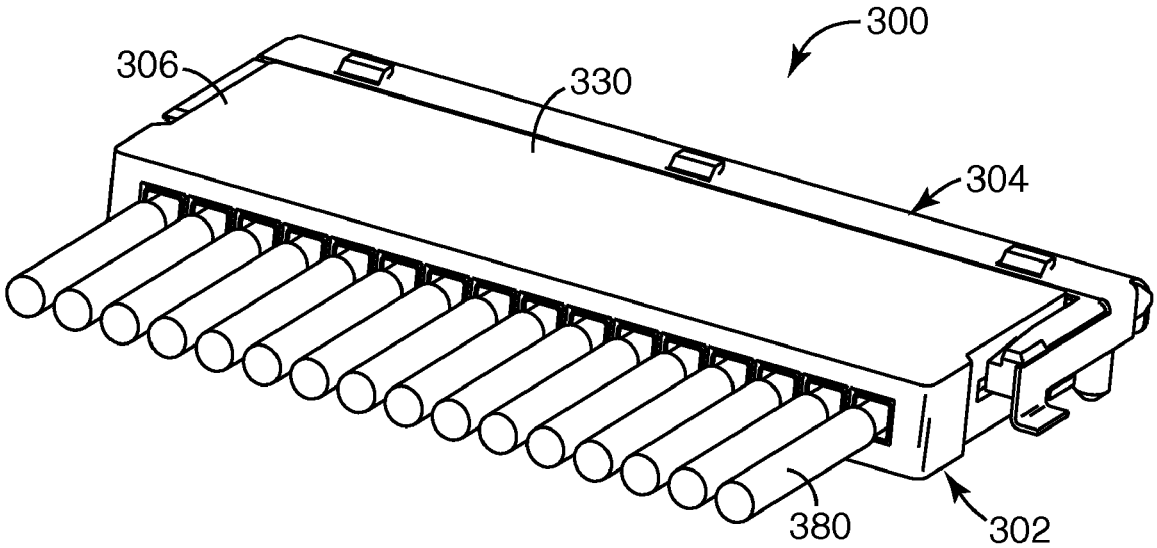
FIG. 19 is a perspective view of the carrier assembly show in FIG. 15 mated with the header shown in FIG. 15.

FIG. 19 is a perspective view of system 300 including carrier assembly 302 mated with header 304. Housing 306 of carrier assembly 302 engages with header 304 such that first and second ground plates 312, 314 (FIG. 15) are captured by (e.g., slide into) housing 306. With additional reference to FIG. 17, first ground plate 312 contacts upper ground beams 352 and second ground plate 314 contacts lower ground beams 354. Shielded connectors 308 are securely retained within housing 306 and aligned to mate with signal pins 370 (FIG. 18) such that the coaxial cables 380 of carrier assembly 302 electrically communicate through a stripline configuration provided by header 304.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of electrical connectors and systems and methods of electrical connection as discussed herein. Therefore, it is intended that this invention be limited only by the claims and the equivalents thereof.

What is claimed is:

1. An electrical connector system comprising:

a carrier assembly comprising a plurality of shielded connectors and a coaxial cable terminated to each of the shielded connectors; and a header comprising opposed ground plates oriented generally parallel to a circuit board with each having solder tabs configured for attachment to the circuit board and a plurality of pins disposed between the opposed plates;

wherein when the carrier assembly is connected to the header, the coaxial cables of the carrier assembly electrically communicate with the circuit board through a stripline configuration in the header.

2. The electrical connector system of claim 1, wherein the opposed ground plates comprise an upper ground plate and a lower ground plate, and each pin comprises a termination portion disposed between two of the solder tabs of the ground plates and a contact portion extending from the termination portion and configured to couple with the contact portion of one of the shielded connectors.

3. The electrical connector system of claim 1, wherein the plurality of shielded connectors comprises a single row of shielded connectors disposed in a plane defined by the single row of shielded connectors, each shielded connector comprising a shield body having a ground beam projecting from an exterior surface of the shield body out of the plane defined by the single row of shielded connectors.

4. The electrical connector system of claim 3, wherein at least one of the opposed ground plates of the header is configured to contact at least one ground beam of at least one of the shield bodies and align the shield bodies between the opposed plates.

5. The electrical connector system of claim 3, wherein the carrier assembly comprises a housing including separator plates that are spaced apart to define a plurality of ports, each port configured to receive one of the shielded connectors.

6. The electrical connector system of claim 5, wherein leading portions of the opposed ground plates define a plurality of slots and a finger between adjacent slots, each slot configured to receive one separator plate and each finger configured to be captured between the carrier assembly housing and one of the shield bodies.

7. The electrical connector system of claim 6, wherein the separator plates of the carrier assembly insert into the slots of the opposed ground plates of the header to laterally align the contacts in the shielded connectors with the pins in the header, and the fingers of the opposed plates capture the shielded connectors to vertically align the contacts in the shielded connectors with the pins in the header.

8. The electrical connector system of claim 7, wherein each of the fingers comprise a tapered leading end that is configured to capture the shield body of each of the shielded connectors and provide a lead-in configured to receive one of the separator plates of the carrier assembly.

9. The electrical connector system of claim 8, wherein the opposed ground plates comprise an upper ground plate and a lower ground plate, and the upper ground plate comprises first solder tabs and the lower ground plate comprises second solder tabs that interdigitate with the first solder tabs to define a substantially continuous ground shield along a trailing end of the header.

10. The electrical connector system of claim 1, wherein the header comprises an electrical insulator supporting a single row of pins, and crosstalk to each of the pins is minimized by a dielectric distance between adjacent pins being about twice a dielectric thickness extending between one of the pins and one of the opposed first and second plates.

11. A connector configured to electrically couple a carrier assembly to a circuit board, the connector comprising:

an electrical insulator supporting a row of pins, each pin comprising a contact portion configured for connection with a coaxial cable of the carrier assembly and a termination portion extending from the contact portion and configured to couple to the circuit board; and a first plate disposed on a first side of the electrical insulator and a second plate disposed on a second side of the electrical insulator, each of the first and second plates comprising a leading portion parallel to the contact portion of the pin that combine to form a stripline connector configured to pass signals between the coaxial cables of the carrier assembly and the circuit board, wherein at least one of the first and second plates includes a trailing end portion configured to couple to the circuit board arranged opposite and at an angle to the leading end.

12. The connector of claim 11, wherein the second plate comprises a fabricated feature of the circuit board.

13. The connector of claim 11, wherein the leading portion of at least one of the first and second plates comprises a continuous plate extending substantially between first and second sides of the connector.

14. The connector of claim 11, wherein each of the first and second plates comprises a trailing end portion opposite the leading end, the trailing end portion of the first plate comprising a plurality of spaced apart first solder tabs and the trailing end portion of the second plate comprising a plurality of spaced apart second solder tabs.

15. The connector of claim 14, wherein the trailing end portion of each of the first and second plates is parallel to the termination portion of the pin and configured to ground shield the termination portion of the pin on at least two sides.

16. The connector of claim 14, wherein the termination portion of each pin is offset from one of the first solder tabs and lateral sides of the termination portion of each pin are disposed between adjacent second solder tabs.

17. The connector of claim 14, wherein each of the first solder tabs comprise a segment disposed at a right angle relative to the first plate and each of the second solder tabs comprise a segment disposed at a right angle relative to the second plate such that the termination portion of each pin is electrically shielded on at least three sides by the segments of the first and second solder tabs.

18. The connector of claim 17, wherein each of the first and second plates is fixed relative to the electrical insulator such that the termination portion of each pin is maintained at a fixed distance from a ground defined by the segments of the first and second solder tabs.

19. The connector of claim 17, wherein each pin comprises a substantially coaxial structure having about 75% of a circumference of the structure surrounded by a ground formed in part by the segments of the first and second solder tabs and in part by the opposed first and second plates.

20. The connector of claim 11, wherein the stripline connector comprises a controlled impedance stripline configuration.

21. A carrier assembly configured to electrically couple with a circuit board, the carrier assembly comprising:

a housing comprising a first wall offset from a second wall to define a plurality of housing ports; and a single row of shielded connectors, each shielded connector disposed in one of the housing ports and including a coaxial cable terminated to a contact and a shield body disposed around the contact;

wherein each shield body comprises a ground wiper extending from an exterior of the shield body toward one of the first and second walls of the housing and configured for coupling to a controlled impedance header.

22. The carrier assembly of claim 21, wherein the first wall of the housing comprises a plurality of spaced apart first fences that are integrally formed on an interior surface of the first wall and the second wall of the housing comprises a plurality of spaced apart second fences that are integrally formed on an interior surface of the second wall, each housing port formed between opposing first and second fences.

* * * * *